United States Patent [19]

Sanderson et al.

[11] Patent Number: 4,704,970

[45] Date of Patent: Nov. 10, 1987

[54] CONCEALED HINGE FOR LIGHTWEIGHT SAFES

[75] Inventors: Robert A. Sanderson; Gaius P. Crosby, both of Orem, Utah

[73] Assignee: Thomas A. James, Mapleton, Utah

[21] Appl. No.: 598,259

[22] Filed: Apr. 9, 1984

[51] Int. Cl.[4] ..... E06B 3/34; E05D 11/04

[52] U.S. Cl. ..... 109/73; 109/74; 16/275; 16/389; 49/398

[58] Field of Search ..... 109/59 R, 59 T, 74, 109/73, 75, 77, 79; 16/389-391, 262, 265, 275; 49/398

[56] References Cited

U.S. PATENT DOCUMENTS

| | | | |
|---|---|---|---|
| D. 272,597 | 2/1984 | Cascone et al. | 16/391 |
| 721502 | 2/1903 | Carter | 16/390 |
| 2,319,600 | 5/1943 | Heath | 16/389 |
| 2,661,085 | 12/1953 | Weinthal et al. | 16/389 |
| 3,832,755 | 9/1974 | Maertin et al. | 16/275 |
| 4,426,935 | 1/1984 | Nikoden, Jr. | 109/79 |

FOREIGN PATENT DOCUMENTS

| | | | |
|---|---|---|---|
| 871312 | 4/1942 | France | 49/398 |
| 1179410 | 12/1958 | France | 16/275 |
| 2391342 | 1/1979 | France | 109/74 |
| 701942 | 3/1966 | Italy | 16/275 |

OTHER PUBLICATIONS

General Metals, Inc. brochure dated Nov. 1982, depicting Arms Gard Security Cabinets, (4 pages).

Provo Steel & Supply Co.-Brochure dated 1980, depicting Pro-Steel Security Safes (6 pages).

Browning brochure undated, (post 1982), depicting Pro-Steel Security Safes, (8 pages).

Tread Corporation brochure dated Jan. 1, 1983, depicting Treadlock Security Chests, (Cover page, pp. 4 & 5).

*Primary Examiner*—Gary L. Smith

*Assistant Examiner*—Neill Wilson

*Attorney, Agent, or Firm*—Trask, Britt & Rossa

[57] ABSTRACT

A hinge assembly composed of a planar-surfaced mounting bracket, a pivoted connection means, and an approximately "J"-shaped leaf member is disclosed. The hinge, being configured to function in a concealed fashion, operates to pivotedly mount a recessed door within a security enclosure.

19 Claims, 8 Drawing Figures

CONCEALED HINGE FOR LIGHTWEIGHT SAFES

BACKGROUND OF THE INVENTION

1. Field

The instant invention relates to a hinge mechanism and method for mounting same for use with metal security enclosures. Specifically, the mechanism is directed for use on the interior of a lightweight safe thereby concealing the hinge from a view exterior to the safe.

Prior Art:

The art of applying hinge mechanisms to cabinets and safes has long been practiced. Usual applications have involved the use of hinges configured for mounting on the exterior of the cabinet or safe. Structures having hinge constructions are disclosed in U.S. Pat. No. 4,288,944 (Donovan); U.S. Pat. No. 393,883 (Brown); U.S. Pat. No. 1,870,746 (Pyle); U.S. Pat. No. 2,996,322 (McClellan); U.S. Pat. No. 2,823,536 (Watson); U.S. Pat. No. 2,039,124 (Stryker); and U.S. Pat. No. 2,860,584 (Deaton).

Typical hinge construction includes the use of a pair of relatively plate-like leaf members being made intercooperable by inclusion of a coupling, pivoting means. Generally such a pivoting means involves the placement of co-axially aligned cylindrical retaining means in the leaf members. A pivot pin whose longitudinal axis forms the pivot axis of the hinge is inserted into the respective retaining means thereby detachably joining the leaves while permitting the leaves to pivot with respect to each other. These hinges, being used with non-recessed doors, are generally aligned vertically near a side edge of the safe. Being mounted on the exterior, such hinges are readily accessible to those attempting forcible entry of the safe. Not only is the hinge mechanism itself susceptible to attack, but oftimes the mountings of the hinge on the door or door frame are similarly exposed to prying or impact tools as well as cutting torches.

The use of concealed hinges to circumvent the aforementioned failings is complicated by the requirement of minimizing the amount of interior safe space requisite for the hinge's operation. A safe's primary purpose is the provision of a secured space for storage of valuables. Naturally, a diversion of such space for hinge operational purposes detracts from the safe's utility as well as value.

In addition to spatial considerations, the configuration of a safe door and its attendant door frame structure present formidable obstacles. A hinge required to operate within such a configuration must conform its function to the configuration while jointly permitting a reasonable accessibility to the safe's interior and contents.

Typical of safes constructed utilizing concealed hinges are those of General Metals, Inc. of Greensboro, N.C. and Tread Corp. of Roanoke, Va. These safes make use of a laminated linked hinge assembly embedded in the front face of the safe. Both safes employ an overlapping door which, when closed, effectively covers and conceals the front of the safe along with the subject hinges.

Presently, the safe industry is pursuing increased security by recessing the safe door into a door opening frame circumscribed within the front face of the safe. This construction involves a door which is either flush with or slightly recessed from the plane of the safe's front face. In appearance, the safe's front face presents a marginal border circumscribing the safe's door. The door opening is fitted with a box-like peripheral mounting well within which the door is snugly seated. Such a door construction restricts intruder access to the edges of the safe door. Thereby, opportunities for insertion of prying tools or wedges between the door and its attendant frame are minimized.

The provision of a concealed hinge in a recessed door configuration confronts a series of complications. Specifically, the configuration of the door frame and its attendant mounting well present a formidable obstacle to the operation of traditional hinges. Proper hinge operation is required to circumvent the frame so as to retain the security advantages obtained through the frame.

The hinge constructions of General Metals and Tread, being mounted on the face of the safe, appear to be ill-suited for use in a recessed door environment. A recessed door does not have the concealment effect of an overlapping door. Furthermore, the short distance from the hinge's pivotal axis to the mounted door would preclude the hinge's operation without the door binding against the marginal face border found in recessed door construction.

Moreover, the consumption of interior safe area by the recessed door frame intensifies the need for restricting the spatial requirements of any hinge operation.

Not only is the structuring of a concealed hinge beset with difficulty, but jointly, its attachment to the safe is also ladened with problems. The actual mounting of a concealed hinge within a safe's interior is complicated by a need to have the door in a closed position so as to properly align it during the mounting operation. Given that the main structure of the safe has already been assembled prior to the mounting of the hinges, it may be realized that the manufacturer is being required to mount the hinge within a totally enclosed container.

SUMMARY OF THE INVENTION

A concealed hinge for use in metal security enclosures has been invented. The hinge, though adaptable to overlapped door constructions, is specifically directed to recessed door configurations.

Structurally, the hinge includes a mounting bracket, a leaf member having a unique configuration, and a pivoted connection means adapted to interrelate the bracket with the leaf member.

The mounting bracket generally may include a structure having an exterior surface of sufficient dimensions to permit the bracket's attachment to an interior wall of the safe. The bracket preferably presents an approximately planar construction which permits an extensive bracket-wall surface interaction while the hinge is in situ. This mounting may occur on the interior surface of the front face of the safe near the door opening. Furthermore, the bracket includes suitable structure to receive the pivoted connection means, thereby detachably intercooperating the bracket with a leaf member. Generally, this connection means may require the bracket to have a cylindrical cavity recessed therein. The cavity is specifically dimensioned to slidably receive a pivot pin which forms the main component of the connection means.

The leaf member, being generally fabricated from a rigid material, possesses a modified "J"-shape, so as to facilitate an optimal outward spatial swing for the safe door. Though this distinctive shape is specifically adapted for use with doors and door frames utilizing a recessed door construction, the structure is equally adaptable to safes incorporating an overlapped door.

Subsequent to the assembly of the safe's box-like structure, the concealed hinge is secured to the interior of the safe's front face. This mounting is accomplished by initially drilling a hole through the front face. The hole's orientation is arranged to correspond to the proposed location of the hinge. The door having its hinge pre-attached is then positioned within its mounting well. The positioned door orients the mounting surface of the hinge bracket such that it abuts the hole in the front face. The manufacturer may then seal the hole by appropriate adhesive means; e.g., welding. The adhesive flows through the hole contacting the mounting bracket whereby the bracket is secured to the front face. The door is then opened permitting the joint to be accessed for further adhesive application. Subsequently, the sealed hole is sanded so as to form a flush surface with the surrounding front face of the safe.

DESCRIPTION OF THE ILLUSTRATED EMBODIMENT

Figure 1:
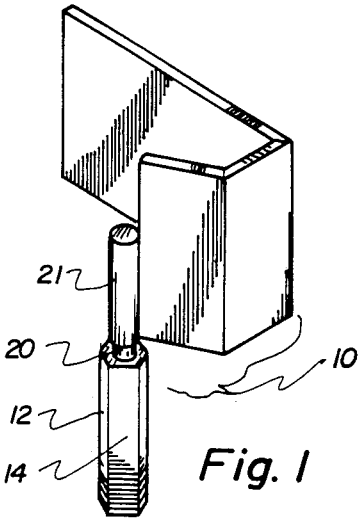
FIG. 1 is a front elevational view of a concealed hinge for use in metal security enclosures. The mounting bracket is shown configured as a hexagonal bolt-like member presenting a flat planar surface for mounting on the enclosure's interior wall.

FIG. 1 is an elevational front view of a hinge, generally 10, as it would appear if mounted to the interior of the safe's front face. A mounting bracket 12 is shown in a generally hexagonal shape presenting thereby a flat plate-like surface 14 for mounting the bracket on the safe's front face 16 interior wall 18. The hexagonal configuration is a preferred bracket shape though alternative shapes may readily be suggested to those skilled in the art. Alternate bracket configurations may permit the bracket's mounting in other locations within the safe's interior.

A smooth-surfaced cylindrical pin 20, having a vertically extending longitudinal axis 21, is shown partially encased within the bracket 12. The ends 22 of pin 20 are shown configured with generally flat, planar surfaces though other surface configurations may be adopted.

Figure 3:
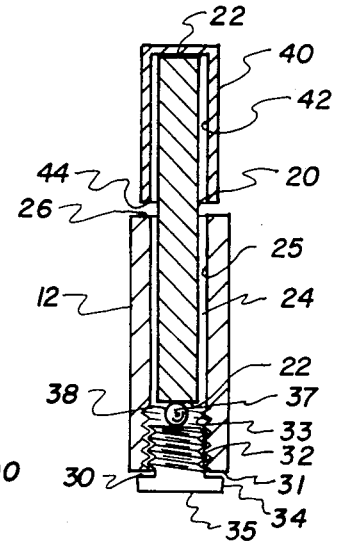
FIG. 3 is a cross-sectional view of a pivoted connection means for interrelating the mounting bracket with the leaf mounted retaining member.
Figure 4:
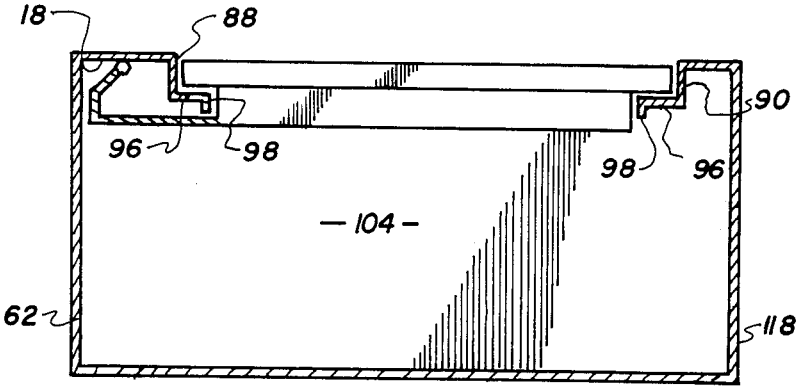
FIG. 4 is a top cross-sectional view of a security enclosure having a recessed door assembly. The safe door is shown removed slightly from its mounting well for purposes of clarity.
Figure 5:
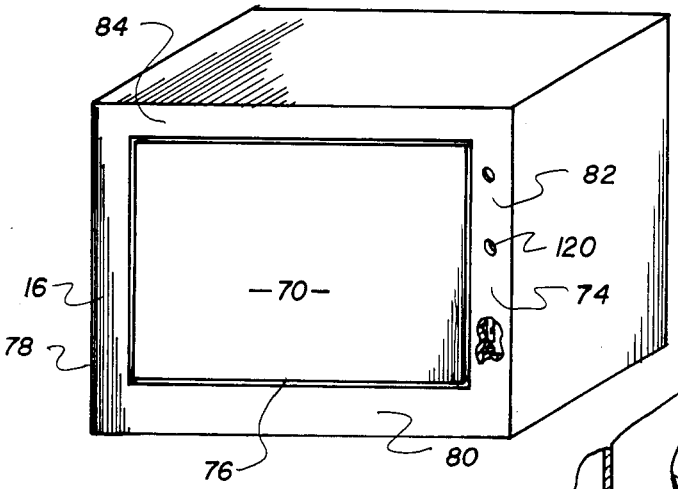
FIG. 5 is a elevational perspective view of a security enclosure containing a recessed door. Cut-away portion (Inset A) reveals the placement of an interior mounted hinge; and FIG. *5a* is an enlarged view of the cut-away portion of the security enclosure illustrated in FIG. 5.
Figure 5A:
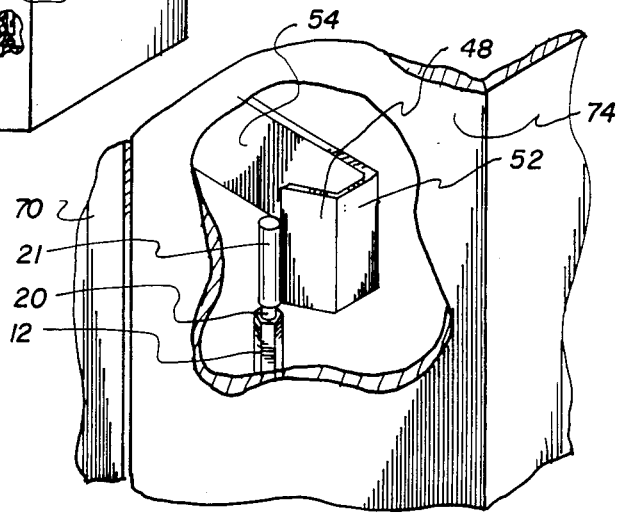
Figure 6:
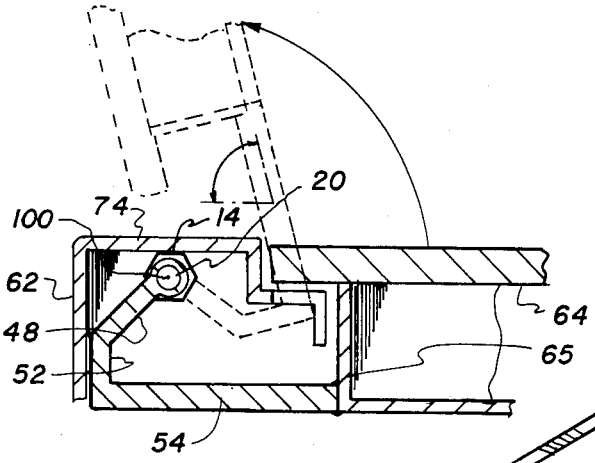
FIG. 6 is a top cross-sectional view of a single pivot hinge of this invention. Shown in phantom is the hinge opened to its furthermost position.
Figure 7:
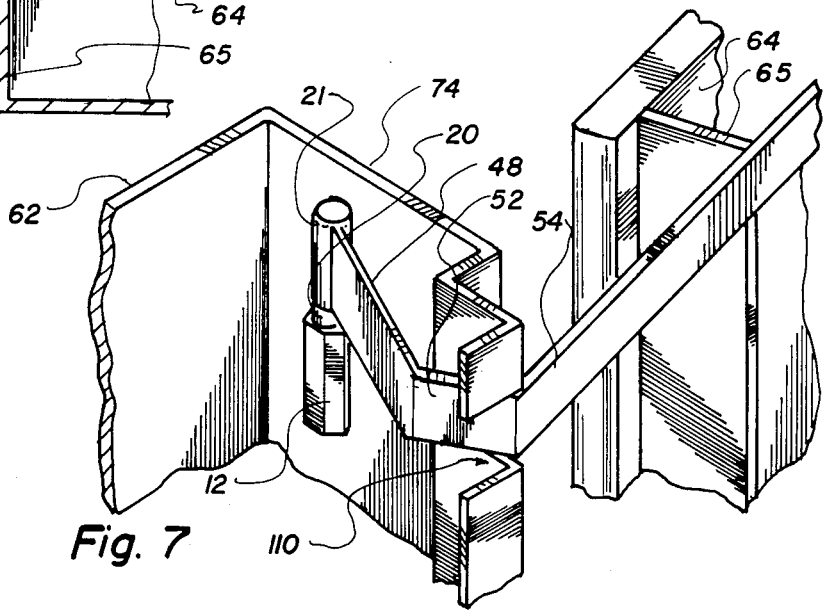
FIG. 7 is an elevational perspective view of the hinge shown in FIG. 6.

FIG. 3 more clearly illustrates the pin-bracket construction. The pin 20 is housed within a generally cylindrical mounting well 24 formed within the interior of the bracket 12. The mounting well 24 is dimensioned to be slightly larger in cross-section than pin 20 permitting the well to slidably receive the pin within the well. The walls 25 of the well are smooth facilitating the easy rotative action of the pin 20 within the well. The pin 20 may rotate independently of the mounting well 24 and bracket 12.

The bracket 12 contains an opening 26 at its upper end 28 communicating with the well 24. The opening is aligned with the longitudinal axis of the well 24 and suitably dimensioned to enable pin 20 to be inserted therethrough to access the well 24. A second access opening 30 is placed similarly in the lower end 31 of the bracket 12. This opening is also sized to permit the passage therethrough of the pin 20.

The access opening 30 as shown includes an axially threaded female socket 32 depended within the opening itself. Socket 32 is suitably dimensioned to permit the unimpeded passage therethrough of pin 20. The threads 33 are dimensioned to intercooperate with those of a male plug 34 which is removably positioned into the socket from below. The plug 34 serves to retain the pin 20 and its attendant structure within the mounting well 24 in addition to providing a means of manually adjusting the hinge 10 by raising or lowering the pin 20 thereby controlling its depth of penetration into the socket 32. Plug 34 is adapted on its lower end 35 with a countersunk impression 36 suitably configured to interrelate with a screwdriver-like implement (not shown). The impression 36 permits manual adjustment or disassembly of the hinge while it is in operation.

Seated on the upper surface of the connector plug 34 is a bearing means 37. As shown, this bearing means may include a spherical ball bearing 38 positioned so as to rotatively support the superior pin member 20. In effect, the pin 20 rides on top of the bearing 38. The ball bearing 38 is preferably sized to be slightly smaller in diameter than its containing well 24. This dimensioning permits the bearing to rotate freely while maintaining its point of contact with the superior pin 20 within a rather confined spatial tolerance. The pin 20 and ball bearing 38 are both dimensioned to be slidably insertable and retractable through access opening 30. To disassemble the hinge, the plug 34 is removed from access opening 30 whereupon the bearing 38 and pin 20 are retracted from the hinge, downwardly through the access opening 30, by the force of gravity.

Rotatively embracing the upper portions of the pin member 20 is a retaining means 40. The illustrated embodiment configures this means as a hollow shaft-like member possessing a cylindrical cavity 42 therein. The cavity 42 is dimensioned to slidably receive the pin member 20 while permitting that member to rotate freely therein. In similar construction to the bracket 12, this retaining means 40 possesses an access opening 44 communicating with the interior cavity 42 dimensioned to permit insertion therethrough of pin 20, while permitting the freely rotative action of that pin.

Attached securely to this retaining means is a generally "J"-shaped cross-section leaf member, generally 48. This leaf member may be sectionalized into three distinct shaft-like panels 50, 52, 54. The first panel 50 includes a mounting surface 56 adapted to be mounted on the retaining means 40 in a fashion permitting the panel to be positioned radially from the longitudinal axis 21 of the pin 20. As shown, the panel 50 is generally disposed vertically. A second panel 52 is mounted on the surface 57 of the first panel 50. This second panel 52 is also generally disposed vertically. The juncture of the first and second panel members presents an obtuse included angle 58. This angle may vary in measurement though a prefered embodiment requires an included angle measurement of approximately 135°. On the outermost portion 60; i.e. the furthermost radially positioned portion, of the second panel 52, a third panel 54 is attached. This third panel 54 is generally disposed vertically. The intersection of the second and third panels 52, 54 defines an approximately 90° included angle.

When the safe door 64 is in its closed position, the positioning of the second panel 52 is generally aligned parallel to the vertical safe side panel 62 and hence perpendicular to the front face 66 of the safe. In contrast, the third panel 54 is disposed generally parallel to the front face 66 of the safe 70.

The third panel 54 extends from its mounting on the second panel member 52 to contact the door extension 65 of the safe. The door-contacting portion of the panel is configured to form a mounting surface 72 whereby the panel 54 is securely attached to the door 64.

Figure 2:
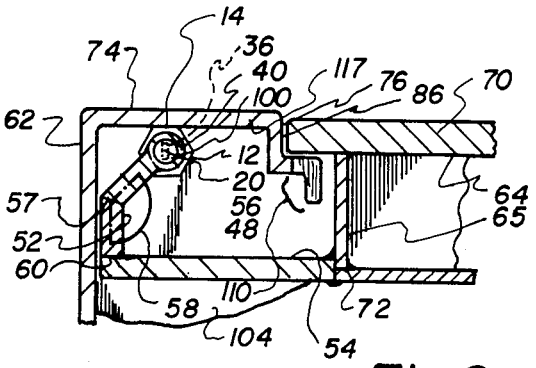
FIG. 2 is a top view of a hinge of this invention mounted within the interior of a metal security enclosure. Portions of the safe door are shown in shaded relief.

The illustrated hinge is specifically directed for use on the recessed door of a metal security enclosure. The detailed mounting arrangement of a hinge on such a safe is shown in FIG. 2. Generally, a recessed door configuration involves the use of marginal front face, generally 74, which serves to circumscribe the door opening 76. Front face 74 is generally composed of four planar sections 78, 80, 82, 84 which form a narrow peripheral border around the door opening 76. A door frame 86 is formed by folding the margin of the border inwardly thereby forming a pair of vertical door jambs 88, 90, a door sill (not shown), and a lintel (not shown). A peripheral door frame flange 96 is formed by a reverse bend. An interframe 98 is formed by a further inward bend of the sides, top and bottom. The resulting construction appears somewhat step-like.

The mounting of panel 52 on panel 50 may be spaced at approximately the same radial distance from the longitudinal axis 21 of pin 20 as is the line defined by the intersection of the plane of door jamb 88 with the plane of flange 96.

Generally, the mounting bracket 12 of the hinge 10 is attached to an interior of the marginal front face 74. Typically, a plurality of hinges is aligned vertically on one side of the door opening permitting a door operation whereby the door swings outward and toward the side on which the hinges are mounted. FIG. 2 illustrates the placement of the pivot point 100 at a point centrally disposed between door opening 76 and vertical side panel 62.

This configuration obtains an optimal dimensional balance between the door and the attendant marginal front face. It allows a maximum accessibility to the safe's interior 104 by limiting the width of the marginal face 74; i.e., the width required to contain the operation of the hinge 10. As a result, the door width is maximized. Thereby, the safe door's swing and hence the safe's accessibility is enhanced. Reduction of the door's width and hence an increase in the marginal face width would shift the pivot point's location from a centrally disposed placement to one more proximate the door opening 76.

Obtention of a maximum arc of swing for the opening door is facilitated by a selective removal of portions of the door frame 86. Specifically, the sections of the frame 110 within the arc of swing of the respective hinge leaves are cut away. The remaining portion as shown by the dotted line in FIG. 2 present a lip-like configuration 112. The remaining sections retain a mounting abutment surface 116 against which the door 64 may rest while continuing to obscure the line of sight from exterior the safe into the safe's interior. Resultingly, the door 70 maintains its advantage of reduced susceptibility to prying.

In operation the hinge 10 swings toward the door 64 thereby removing the door from its door frame 86. Continued displacement of the hinge results in the hinge wrapping its somewhat "J"-shaped leaf member 48 around the barrier presented by the cut-away door frame flange 96. In its fully opened position the exterior of the door 64 defines a somewhat acute included angle with the marginal front face 74; i.e., the plane of the fully opened door 64 is not positioned parallel to the plane of the marginal front face 74.

The action of the hinge 10 requires a very limited spatial area. The radial distance from the longitudinal axis 21 of the pin 20 to the outwardly furthermost portion of the second panel member 52 as shown defines the deepest penetration of the hinge 10 into the safe's interior 104.

The attachment of the above described hinge mechanism 10 to the interior surface 117 of the marginal front face 74 is accomplished after the assembly of the main box-like structure, generally 118, of the safe has been completed. First, a series of vertically arranged holes 120 are drilled through the marginal front face 74 corresponding to the proposed hinge locations. The holes 120 are of sufficient depth to communicate with the interior of the safe 104. The door 64 is then positioned within its door frame 86 by the use of appropriately shaped shims (known in the art but not shown). The positioned door 64 with its hinges 10 being pre-attached exposes the mounting surfaces 14 of the respective hinges 10, through the holes 120. An adhesive means; e.g. welding, is then utilized to seal the holes 120. The sealing adhesive adheres to the bracket as well as the front face 74 thereby effecting the mounting of the hinge bracket 12 to the marginal front face 74. The door can then be opened permitting the manufacturer to complete the mounting of the bracket by applying adhesive to the bracket-interior wall conjunction. The mounting is finished by sanding the portions of the adhesive seal on the front face so as to result in a smooth planar marginal front face surface.

We claim:

1. A concealed hinge for use with a lightweight safe having a door, said hinge comprising:

a bearing means;

a pin member positioned slidably on top of said bearing means so as to ride thereon, the central longitudinal axis of said pin member defining a pivotal axis for said hinge;

a mounting bracket adapted to be mountable on the interior of said safe, said bracket possessing a cavity and a first access opening and a second access opening which communicate with said cavity, said second access opening being dimensioned and positioned to permit a sliding insertion and sliding retraction therethrough of said pin member and said bearing means, said cavity slidably receiving and rotatively embracing, said bearing means and a portion of said pin member whereby said pin-like member is free to rotate about said pivot axis and within said cavity, independently of said mounting bracket; said pin member extending through said first access opening;

sealing means for manually sealing and unsealing said second access opening, said sealing means including:

an axially threaded female socket configured within said second access opening, and an axially threaded male connector plug dimensioned to interact with said female socket to form a manually releasable and adjustable seal for said second access opening;

wherein upon said plug being removed from said socket, said bearing means and said pin member are discharged from said hinge through said second access opening by the force of gravity;

a second retaining means which slidably receives and rotatively embraces a portion of said pin member; wherein said pin member is free to rotate about said pivotal axis independently of said mounting bracket; and a leaf member generally shaped in an approximately "J"-shape cross-section, said leaf member being securely mounted on said second retaining means, said mounting permitting said leaf member to pivot around the pivotal axis of said hinge.

2. In a lightweight safe presenting a box-like structure having a marginal front face which circumscribes a door opening therein, a full back panel parallel to said front face, vertical side panels and top and bottom panels perpendicular to said front face and joining said back panel to said front face to form an open box-like structure, the improvement comprising:

a recess-fit door having inside margins which fits within an offset door frame, said frame comprising:

four first thin panels folded inwardly from the door opening in the safe face and joined along shorter edges to form a box-like frame in which the door recesses, each of said first panels being essentially planar, four second thin panels folded from said first panels to be positioned substantially parallel to said safe face to form an abutment surface against which the inside margins of said door rest when said door is in a closed position, said second panels being essentially planar, and four third thin panels folded from said second panels to be positioned substantially parallel to said respective first panels;

a plurality of hinge members securely mounted vertically on a surface of said marginal front face which faces the interior of said safe, each of said hinges comprising:

a hollow bracket member having an exterior surface area adapted to permit said bracket member's mounting on said interior facing surface of said marginal front face, said bracket member having a smooth, open-ended cavity therein, a bearing means dimensioned to be slidably inserted into and rotatively retained within said cavity, said pin member being positioned to rotatively ride on top of said bearing means, said pin member having a central longitudinal vertically oriented axis, said pin member being free to rotate about said axis independently of said bracket member;

a hollow retaining member having an open-ended cavity therein dimensioned to receive slidably and embrace rotatively said pin member, said pin member being free to rotate about said axis independently of said retaining member; and wherein said bracket member contains a releasably sealable access opening therein which communicates with said cavity whereby said bearing means and said pin member may be slidably inserted and retracted from said cavity, through said access opening and whereby upon said access opening being unsealed, said bearing means and said pin member are removed from said cavity by the force of gravity;

a rigid leaf member mounted on said retaining means such that said leaf member may pivot around said pin member, said pivoting motion of said leaf member operating to sweep out and hence define an arc of swing of said leaf member, said leaf member comprising:

a first shaft member mounted on said retaining means so as to extend radially therefrom, a second shaft member mounted on said first shaft member, the juncture of said shaft members defining an included obtuse angle, and a third shaft member mounted on said second shaft member, said third shaft member being adapted with a mounting surface sufficient to permit attachment of said third shaft member on said recessed door.

3. A lightweight safe according to claim 1 wherein said leaf member comprises:

a first panel member attached to said second retaining means, said first panel member extending approximately radially outward from the central longitudinal axis of said pin-like member;

a second panel member mounted on said first panel member, said mounting defining generally an included obtuse angle; and a third panel member secured to said second panel member, said securement defining generally a right angle, said third panel member possessing a mounting surface permitting attachment of said third panel member to a door of said lightweight safe.

4. The improvement according to claim 3 wherein portions of said second thin panels and said third thin panels, which are positioned within said leaf member's arc of swing, are removed.

5. The improvement according to claim 4 wherein the portions of said second thin panels positioned within a plane of said leaf member's arc of swing are shaped to present a lip appearance of sufficient size to abut the back margins of said safe door over the length of said portions.

6. The improvement of claim 5 wherein said bracket member comprises:

an axially threaded female socket depended within said access opening; and an axially threaded male plug adapted to intercooperate with said female socket to form a manually adjustable and detachable union whereby said access opening is sealed.

7. The improvement of claim 6 wherein said bearing means comprises a spherical ball bearing.

8. The improvement of claim 7 wherein said third shaft member is positioned so as to be aligned parallel to said marginal front face of said safe when said door is in a closed position.

9. The improvement according to claim 8 wherein said mounting of said second shaft member on said first shaft member is positioned at approximately the same radial distance from said longitudinal axis of said pin member as is the intersection of the plane defined by one of said first thin panels with the plane defined by one of said second thin panels.

10. The improvement according to claim 9 wherein:

the mounting of said third shaft member on said second shaft member is positioned at a radial distance from said central longitudinal axis which is greater than the radial distance from said central longitudinal axis to the lip portion of said second panel member.

11. The improvement according to claim 10 wherein said bracket member is mounted centrally on said marginal front face between said door opening and the more proximate of said vertical side panels.

12. In a lightweight safe presenting a box-like structure having a marginal front face which circumscribes a door opening therein, a full back panel parallel to said front face, vertical side panels and top and bottom panels positioned perpendicular to said front face and joining said back panel to said front face to form an open box-like structure having and interior, the improvement comprising:

a recess-fit door having inside and back margins which fits within an offset door frame, said frame comprising:

four first thin panels folded inwardly from the door opening in the safe face and joined along shorter edges to form a box-like frame in which the door recesses, each of said first panels being planar, four second thin panels folded from said first panels to be positioned parallel to said safe face to form an abutment surface against which the inside margins of said door rest when said door is in a closed position, said second panels being planar, and four third thin panels folded from said second panels to be positioned parallel to said respective first panels;

a plurality of hinge members securely mounted vertically on a surface of said marginal front face which faces the interior of said safe, each of said hinges comprising:

a hollow bracket member having a hexagonal surface exterior surface shape which is adapted to permit said bracket member's mounting on said interior facing surface on said marginal front face, centrally between said door opening and the more proximate of said vertical side panels, said bracket member having a smooth, open-ended cavity therein, a spherical ball bearing dimensioned to be slidably inserted into and rotatively retained within said cavity, a pin member dimensioned to be slidably inserted into and rotatively retained within said cavity, said pin member being positioned to rotatively ride on top of said bearing means, said pin member having a central longitudinal vertically-oriented axis, wherein said bracket member contains an access opening therein which communicates with said cavity whereby said bearing means and said pin member may be slidably inserted and retracted from said cavity;

wherein an axially threaded female socket is depended within said access opening; and an axially threaded male plug associated with said female socket to form a manually adjustable and detachable union whereby said access opening is sealed; and a hollow retaining member having an open-ended cavity therein dimensioned to receive slidably and embrace rotatively said pin member, and a rigid leaf member mounted on said retaining means such that said leaf member may pivot around said pin member, said pivoting motion of said leaf member operating to sweep out and hence define an arc of swing of said leaf member, wherein said portions of said second thin panels and said third thin panels, which are positioned within said leaf member's arc of swing, are removed; said portions of said second thin panels positioned within a plane of said leaf member's arc of swing being shaped to present a lip-like appearance of sufficient size to abut the back margins of said safe door over the length of said portions, said leaf member comprising:

a first shaft member mounted on said retaining means so as to extend radially therefrom, a second shaft member mounted on said first shaft member, the juncture of said shaft members defining an included obtuse angle, said mounting of said second shaft member on said first shaft member being positioned at approximately the same radial distance from said longitudinal axis of said pin member as is the intersection of a plane defined by one of said first thin panels with a plane defined by one of said second thin panels; and a third shaft member mounted on said second shaft member, said third shaft member being positioned to be aligned parallel to said marginal front face of said safe when said door is in a closed position; said third shaft member being adapted with a mounting surface sufficient to permit attachment to said third shaft member on said recessed door;

said mounting of said third shaft member on said second shaft member being positioned at a radial distance from said central longitudinal axis which is greater than the radial distance from said central longitudinal axis to the lip portion of said second panel member.

13. The improvement according to claim 11 wherein said second shaft member is aligned parallel to said vertical side panels when said door is in its closed position.

14. The improvement according to claim 13 wherein the mounting of said second shaft member on said first shaft member defines an included angle of approximately 135°.

15. A concealed hinge for use with a lightweight safe having a door, said hinge comprising:

a bearing having a spherically configured exterior surface;

a pin member positioned on top of said bearing so as to ride slidingly thereon, the central longitudinal axis of said pin member defining a pivotal axis for said hinge;

a mounting bracket adapted to be mountable on the interior of said safe, said bracket incorporating a first retaining means which slidably receives and rotatively embraces said bearing and a portion of said pin member; said first retaining means including a releasable sealing means for retaining said bearing and said pin member within said mounting bracket wherein upon said sealing means being released, said bearing and said pin member are discharged from said bracket by the force of gravity;

said pin member being free to rotate about aid pivotal axis within said first retaining means independently of said first retaining means;

a second retaining means which slidably receives and rotatively embraces a portion of said pin member; and a leaf member generally shaped in an approximately "J"-shaped cross-section, said leaf member being securely mounted on said second retaining means, said mounting permitting said leaf member to pivot about the pivotal axis of said hinge.

16. The hinge according to claim 15 wherein said first retaining means comprises:

a structural member possessing an open-ended cavity which slidably receives and rotatively embraces said bearing and a portion of said pin member, said structural member containing an access opening which communicates with said cavity and a releasable sealing plug associated with said access opening to seal said access opening, said access opening being dimensioned and configurated to permit the slidable insertion and retraction therethrough of said pin member and said bearing, wherein said bearing and said pin member are discharged from said mounting bracket by the force of gravity upon an unsealing of said access opening.

17. The hinge according to claim 16 wherein said access opening is adapted with sealing means to manually seal and unseal said access opening.

18. The hinge according to claim 17 wherein said sealing means includes:

an axially threaded female socket depended within said access opening; and an axially threaded male connector plug dimensioned to cooperate with said female socket to form a manually releaseable and adjustable seal for said access opening.

19. A concealed hinge for use with lightweight safes according to claim 18 wherein said leaf member comprises:

a first panel member attached to said second retaining means, said first panel member extending radially outward from the central longitudinal axis of said pin member;

a second panel member mounted on said first panel member, said mounting defining an included obtuse angle; and a third panel member secured to said second panel member, said securement defining generally a right angle, said third panel member possessing a mounting surface permitting attachment of said third panel member to a door of said lightweight safe.

* * * * *